US006719064B2

(12) United States Patent
Price-Smith et al.

(10) Patent No.: US 6,719,064 B2
(45) Date of Patent: Apr. 13, 2004

(54) EXPANDABLE COMPLETION SYSTEM AND METHOD

(75) Inventors: Colin J. Price-Smith, Missouri City, TX (US); Patrick W. Bixenman, Bartlesville, OK (US); Craig D. Johnson, Montgomery, TX (US); Matthew R. Hackworth, Pearland, TX (US); Garry Sinclair, Aberdeen (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/078,228

(22) Filed: Feb. 19, 2002

(65) Prior Publication Data

US 2003/0089496 A1 May 15, 2003

Related U.S. Application Data

(60) Provisional application No. 60/337,788, filed on Nov. 13, 2001.

(51) Int. Cl.[7] ..... E21B 33/124

(52) U.S. Cl. ..... 166/387; 166/51; 166/120; 166/207; 166/227

(58) Field of Search ..... 166/375, 387, 166/386, 51, 207, 212, 227, 228, 236, 120

(56) References Cited

U.S. PATENT DOCUMENTS

| | | | | |
|---|---|---|---|---|
| 3,203,451 A | | 8/1965 | Vincent | |
| 3,489,220 A | | 1/1970 | Kinley | |
| 5,337,823 A | | 8/1994 | Nobileau | |
| 5,366,012 A | | 11/1994 | Lohbeck | |
| 5,396,957 A | | 3/1995 | Surjaatmadja et al. | |
| 5,901,789 A | | 5/1999 | Donnelly et al. | |
| 5,924,745 A | | 7/1999 | Campbell | |
| 5,984,568 A | | 11/1999 | Lohbeck | |
| 6,135,208 A | | 10/2000 | Gano et al. | |
| 6,253,850 B1 | | 7/2001 | Nazzai et al. | |
| 6,263,966 B1 | | 7/2001 | Haut et al. | |
| 6,263,972 B1 | | 7/2001 | Richard et al. | |
| 6,273,634 B1 | | 8/2001 | Lohbeck | |
| 6,328,113 B1 | | 12/2001 | Cook | |
| 6,457,518 B1 | * | 10/2002 | Castano-Mears et al. | 166/207 |
| 6,478,091 B1 | * | 11/2002 | Gano | 166/373 |
| 6,510,896 B2 | * | 1/2003 | Bode et al. | 166/276 |
| 2002/0121372 A1 | | 9/2002 | Cook et al. | |
| 2002/0148612 A1 | | 10/2002 | Cook et al. | |

FOREIGN PATENT DOCUMENTS

| | | |
|---|---|---|
| WO | WO 00/61908 | 10/2000 |
| WO | WO 01/46551 | 6/2001 |

* cited by examiner

*Primary Examiner*—Zakiya Walker
(74) *Attorney, Agent, or Firm*—Robert Van Someren P.C.; Jeffrey Griffin; Brigitte Jeffery Echols

(57) ABSTRACT

A well completion has an expanded tubing portion and an unexpanded tubing portion. A seal is provided on the unexpanded portion. In another embodiment, an expandable tubing is provided and a gravel pack operation is performed.

30 Claims, 4 Drawing Sheets

EXPANDABLE COMPLETION SYSTEM AND METHOD

CROSS REFERENCE TO RELATED APPLICATIONS

The following is based on and claims the benefit of provisional application No. 60/337,788 filed Nov. 13, 2001.

BACKGROUND OF THE INVENTION

The present invention relates to the field of well completions. More specifically, the invention relates to a system and method for completing a well with expandable sections of tubing and sand screens.

Expandable tubing and sand screens are becoming a viable technology for well completion. Further development of systems and methods improving and broadening the use of the expandable technology are desired.

SUMMARY

In general, according to one embodiment, the present invention provides an expandable system that has expanded portions and unexpanded portions. In another embodiment, the present invention comprises gravel packing a well having an expandable tubing therein. The present invention comprises other embodiments as well.

Other features and embodiments will become apparent from the following description, the drawings, and the claims.

BRIEF DESCRIPTION OF THE DRAWINGS

The manner in which these objectives and other desirable characteristics can be obtained is explained in the following description and attached drawings in which.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

In the following description, numerous details are set forth to provide an understanding of the present invention.

However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Also, please note that the terms "seal" and "isolation" are used with the recognition that some leakage may occur and that such leakage may be acceptable. Thus, some embodiments of the present invention may allow for leakage without departing from the scope of the invention and systems that provide for such leakage fall within the scope of the present invention.

Figure 1:
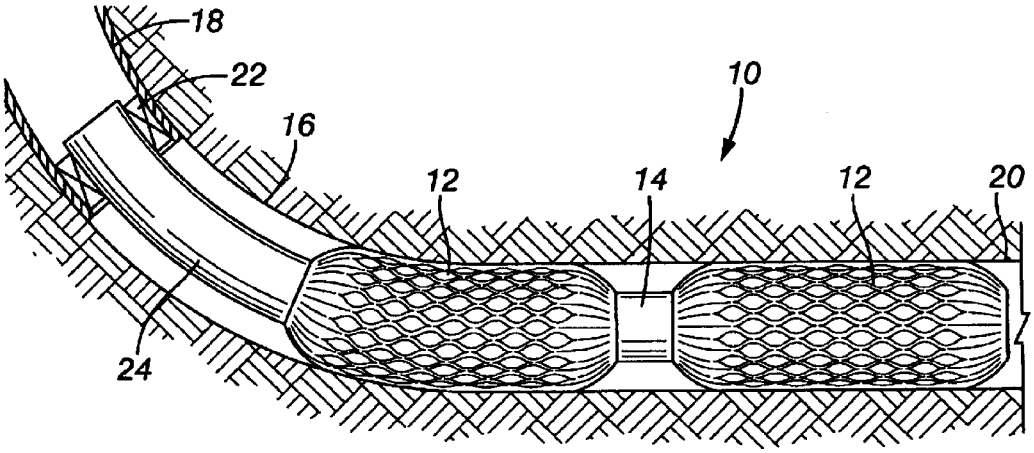
FIG. 1 illustrates an embodiment of the present invention having expanded and unexpanded sections of tubing.

FIG. 1 illustrates an embodiment of the present invention for the expandable completion system 10 in which a plurality of expandable tubing sections 12 are separated by an unexpanded tubing section 14.

As used herein an expandable tubing section 12 comprises a length of expandable tubing. The expandable tubing may be a solid expandable tubing, a slotted expandable tubing, an expandable sand screen, or any other type of expandable conduit. Examples of expandable tubing are the expandable slotted liner type disclosed in U.S. Pat. No. 5,366,012, issued Nov. 22, 1994 to Lohbeck, the folded tubing types of U.S. Pat. No. 3,489,220, issued Jan. 13, 1970 to Kinley, U.S. Pat. No. 5,337,823, issued Aug. 16, 1994 to Nobileau, U.S. Pat. No. 3,203,451, issued Aug. 31, 1965 to Vincent, the expandable sand screens disclosed in U.S. Pat. No. 5,901,789, issued May 11, 1999 to Donnelly et al., U.S. Pat. No. 6,263,966, issued Jul. 24, 2001 to Haut et al., PCT Application No. WO 01/20125 A1, published Mar. 22, 2001, U.S. Pat. No. 6,263,972, issued Jul. 24, 2001 to Richard et al., as well as the bi-stable cell type expandable tubing disclosed in U.S. patent application Ser. No. 09/973,442, filed Oct. 9, 2001. Each length of expandable tubing may be a single joint or multiple joints.

The unexpanded tubing section 14 may comprise a section of tubing or conduit that is of a conventional configuration and not adapted for expansion. Alternatively, the unexpanded tubing section 14 may be a length of expandable tubing that is not expanded or only partially expanded so that its diameter is less than the diameter of the expandable tubing section 12. Although generally shown in the illustrations as a relatively short section, the unexpanded tubing section 14 may be of any length and, in some embodiments, may be hundreds of feet in length.

Referring to FIG. 1, a well 16 has a casing 18 extending to an open-hole portion 20. At the upper end of the expandable completion system 10 is a hanger 22 connecting the expandable completion system 10 to a lower end of the casing 18. A crossover section 24 connects the first expandable tubing section 12 to the hanger 22. Note that any other known method of connecting an expandable tubing to a casing 18 may be used or the expandable completion system 10 may remain disconnected from the casing 18. FIG. 1 is but one illustrative embodiment. A first expandable tubing section 12 (connected to the crossover section 24) is connected to a second expandable tubing section 12 by an unexpanded tubing section 14.

Figure 2:
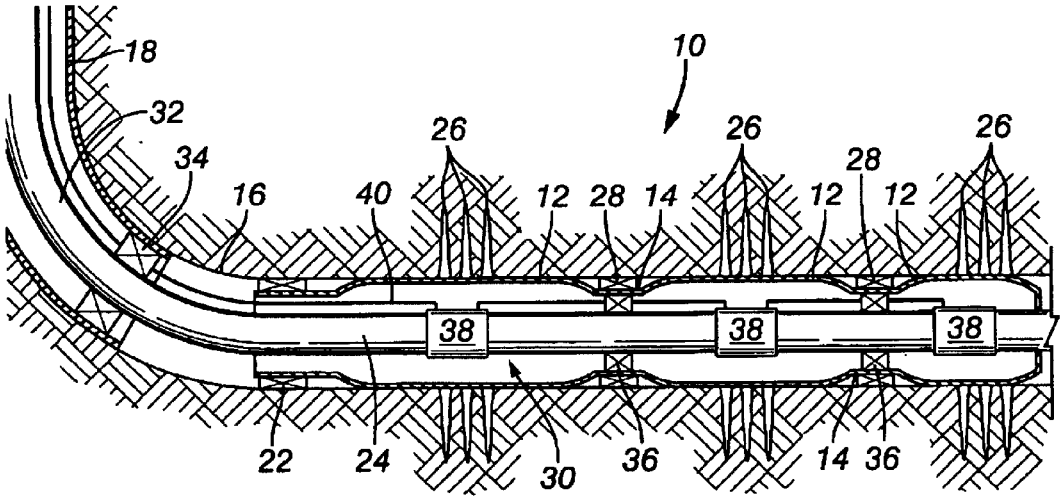
FIG. 2 illustrates an embodiment of the present invention having an expandable completion with zonal isolation.

FIG. 2 illustrates an alternative embodiment of the present invention in which a plurality of expandable tubing sections 12 are separated by unexpanded tubing sections 14. As in the embodiment of FIG. 1, the expandable completion system 10 is connected to the casing 18 of the well 16 by a hanger 22 (which may be a packer). A first expandable tubing section 12 connected to the hanger 22 by a crossover section 24 is also connected to a second expandable tubing section 12 by a first unexpanded tubing section 14. The second expandable tubing section 12 is in turn connected to a third expandable tubing section 12 by a second unexpanded tubing section 14. The expandable tubing sections 12 are aligned with separate perforated zones 26 and expanded. Each of the unexpanded tubing sections 14 has an external casing packer 28 (also referred to generally herein as a "seal") thereon that provides zonal isolation between the expandable tubing sections 12 and associated zones. Note that the external casing packer may be replaced by other seals 28 such as an inflate packer, a formation packer, and or a special elastomer or resin. A special elastomer or resin refers to an elastomer or resin that undergoes a change when exposed to the wellbore environment or some other chemical to cause the device to seal. For example, the elastomer may absorb oil to increase in size or react with some injected chemical to form a seal with the formation. The elastomer or resin may react to heat, water, or any method of chemical intervention.

In one embodiment the expandable tubing sections 12 are expandable sand screens and the expandable completion system 10 provides a sand face completion with zonal isolation. The expandable tubing sections and the unexpanded tubing sections may be referred to generally as an outer conduit or outer completion. In the embodiment of FIG. 2, the zonal isolation is completed by an inner completion 30 inserted into the expandable completion system 10. The inner completion 30 comprises a production tubing 32 extending into the expandable completion system 10. A first packer 34 positioned above the uppermost zone isolates the zone from the remainder of the well 16. Additional packers 36 are aligned with and set in each of the unexpanded tubing sections 14. With each of the zones isolated by the packers 34, 36, the production of each zone may be separately controlled and monitored. It should be noted that the packers 36 maybe replaced by seal bores and seal assemblies or other devices capable of creating zonal isolation between the zones (all of which are also referred to generally herein as a "seal"). The unexpanded tubing section 14 may, in some embodiments, facilitate the isolation of the zones by providing a known inner diameter (as opposed to the generally variable diameter provided by an expanded tubing). In the embodiment shown, a valve 38 in the inner completion 30 provides for control of fluid flow from the associated formation into the production tubing 32. The valve 38 may be controlled from the surface or a downhole controller by a control line 40. Alternatively, the valve 38 may be of the type that requires intervention for actuation from opened to closed. In use, the expandable completion system 10 of FIG. 2 provides a sand face completion that allows for independently controlled production from each zone.

Each isolated zone may further have monitoring and other devices therein as desired. For example, the inner completion 30 may have gauges, sensors, valves, sampling devices, a device used in intelligent or smart well completion, temperature sensors, pressure sensors, flow-control devices, flow rate measurement devices, oil/water/gas ratio measurement devices, scale detectors, actuators, locks, release mechanisms, equipment sensors (e.g., vibration sensors), pH meters, multiphase flow meters, acoustic sand detectors, solid detectors, sand detection sensors, water detection sensors, data recorders, viscosity sensors, density sensors, bubble point sensors, composition sensors, resistivity array devices and sensors, acoustic devices and sensors, other telemetry devices, near infrared sensors, gamma ray detectors, $H_2S$ detectors, $CO_2$ detectors, downhole memory units, downhole controllers, RF tags, locators, and other downhole devices in each isolated zone (referred to generally herein as "intelligent completion devices").

Figure 3:
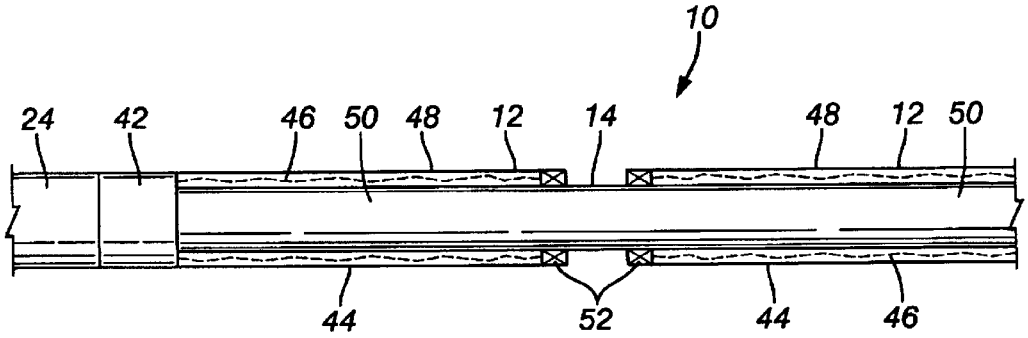
FIG. 3 illustrates an embodiment of the present invention having expandable sand screens connected together by an unexpanded tubing section.

FIG. 3 shows an unexpanded embodiment of the present invention illustrating a crossover section 24 with an adjacent packer section 42. The expandable completion system 10 shown in FIG. 3 also shows a pair of expandable tubing sections 12 connected by an unexpanded tubing section 14. The expandable tubing sections 12 each comprise an expandable sand screen 44. The expandable sand screen 44 has a filter layer 46 interposed between an outer expandable shroud 48 and an inner expandable tubing 50. The expandable completion system 10 also has a pair of expandable seal elements 52 (also referred to generally herein as a "seal") on either side of the unexpanded tubing section 14 that isolate the expandable tubing sections 12 from one another.

Figure 4:
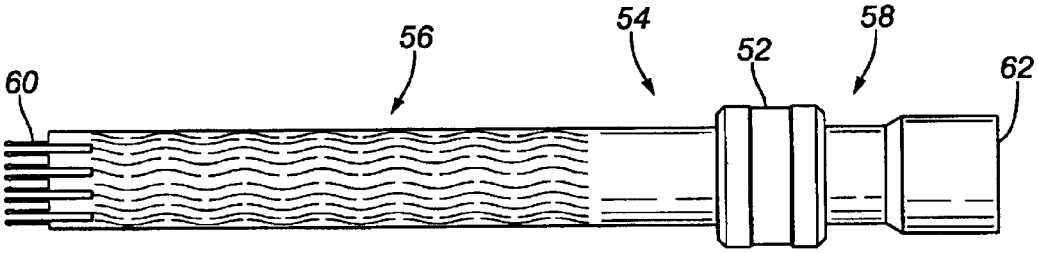
FIG. 4 illustrates an embodiment of a crossover of the present invention.
Figure 5:
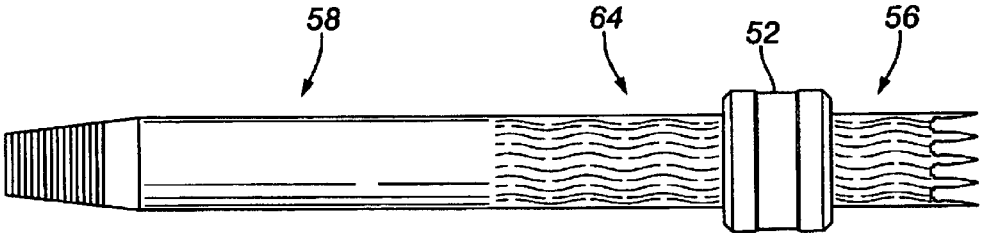
FIG. 5 illustrates an alternative embodiment of a crossover of the present invention.

FIGS. 4 and 5 illustrate components that may be used in the embodiment of FIG. 3. The crossover 54 of FIG. 4 has an expandable portion 56 and an unexpanded portion 58. A seal element 52 is provided on the outer surface of the crossover 54. The expanding end 60 of the crossover 54 is adapted for connection to an expandable tubing section 12. Depending upon the type of expandable tubing used the connection may take many forms. Examples of the types of possible connections are those shown in U.S. Pat. No. 6,273,634 that issued Aug. 14, 2001 to Lohbeck, U.S. Pat. No. 5,984,568 which issued Nov. 16, 1999 to Lohbeck, and U.S. Pat. No. 5,924,745 that issued Jul. 20, 1999 to Campbell as well as U.S. Provisional Patent Application No. 60/263,934 which was filed Jan. 24, 2001.

Likewise, the unexpanded end 62 is adapted for connection to an unexpanded tubing section 14 or another crossover (such as that shown in FIG. 5). The connection of the unexpanded end 62 is made using conventional connections (e.g., threaded connections).

Whereas the crossover 54 of FIG. 4 shows a female crossover 54, the crossover 64 of FIG. 5 is illustrative of an embodiment of a male crossover 64. Like the female crossover 54, the male crossover 64 has an expandable portion 56, an unexpanded portion 58, and a seal element 52 on the outer surface of the crossover 64. As illustrated in the figures, the seal element 52 may be placed on the expandable portion 56 or the unexpanded portion 58. In either case, the seal element 52 is adapted for expansion once properly positioned within the well 16.

Figure 6:
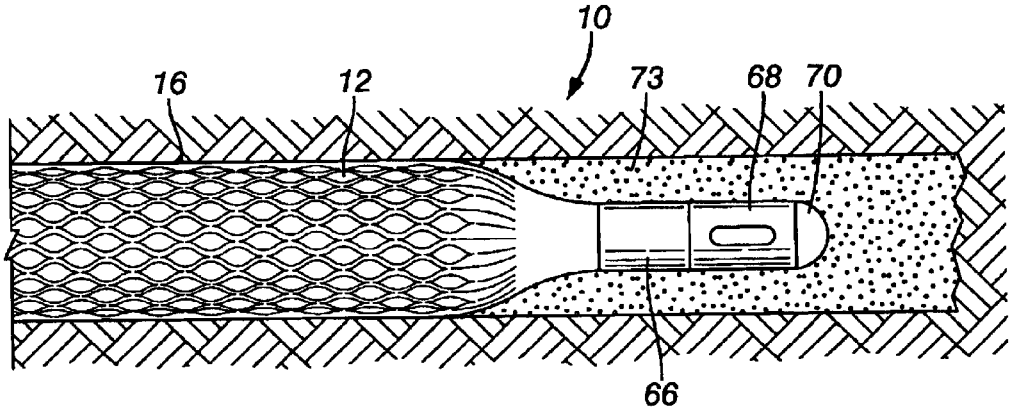
FIG. 6 illustrates an embodiment of the present invention in which the rat hole is gravel packed.

FIG. 6 shows an alternative embodiment of the present invention in which an expandable tubing section 12, which may be an expandable sand screen, is placed in the well 16 and expanded. A bottom end of the expandable tubing section 12 is connected to a crossover 66 connecting the expandable tubing section 12 to an unexpanded gravel packing sub 68. In the embodiment shown, a bull plug 70 is connected to the bottom end of the gravel packing sub 68.

In use, the expandable tubing section 12 is expanded in the well 16. A service string 72 (FIG. 7) is run into the well 16 through the expanded expandable tubing section 12 and into operative engagement with the gravel packing sub 68 and the rat hole 73 of the well 16 is gravel packed. The gravel may be delivered through the gravel packing sub 68 and the return may flow through the expandable tubing section 12 (e.g., expandable sand screen). In an alternative embodiment, the return flows through an unexpanded sand screen provided in the unexpanded tubing section 14. Accordingly, one aspect of the present invention comprises the method of expanding an expandable sand screen in a well 16 and gravel packing the rat hole 73, the area of the well 16 below the expandable sand screen.

Figure 7:
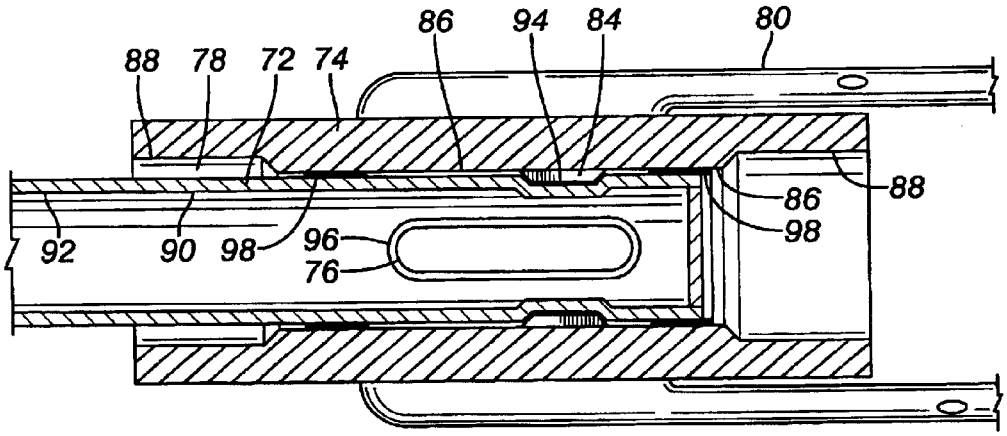
FIG. 7 illustrates an embodiment of the gravel packing sub and service tool of the present invention.

FIG. 7 shows one possible alternative embodiment of a gravel packing sub 68 and service string 72. The gravel packing sub 68 comprises a housing 74 with a port 76 therethrough that communicates the interior passageway 78 of the gravel packing sub 68 with the exterior of the gravel packing sub 68. In an alternative embodiment, shown in the figure, the port 76 may communicate with gravel pack shunt tubes 80 that extend axially along the well 16. The shunt tubes 80 have spaced exit ports that distribute the gravel along the length of the well 16. Within the housing 74 is a locating nipple 84 and a pair of sealing surface 86, one on each side of the port 76. The housing 74 further has end connections 88 that allow it to be connected to the completion.

FIG. 7 also shows an exemplary service tool 90 in mating engagement with the housing 74. The service string 72 is in fluid communication with a work string 92 that extends to the surface. A profile 94 in the service tool 90 ensures proper alignment between an exit port 96 in the service tool 90 and the port 76 of the housing 74. Seals 98 on the service tool 90 on either side of the exit port 96 mate with the sealing surfaces 86 of the housing 74 to provide a sealed flowpath from the interior passageway 78 of the service tool 90, through the exit ports 96 of the service tool 90 and the ports 76 of the housing 74 to the exterior of the housing 74 (which in an alternative embodiment of the invention communicates with shunt tubes 80 as previously described). Thus, gravel delivered through the workstring flows through the service tool 90 and gravel packing sub 68 and is delivered to the desired portion of the well 16.

Figure 8:
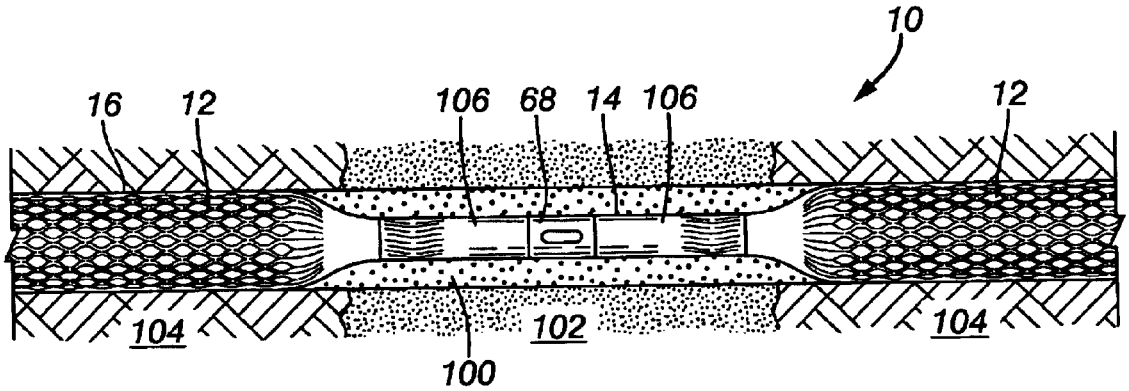
FIG. 8 illustrates an embodiment of the present invention in which the portion of the well between the expandable tubing sections is gravel packed.

FIG. 8 shows an alternative embodiment of the present invention in which the space 100 in the well 16 around an unexpanded tubing section 14 and between expandable tubing sections 12 is gravel packed. In one embodiment, the unexpanded tubing section 14 is positioned in a portion of the well 16 extending through a shale formation 102. The expandable tubing sections 12 are provided, for example in sandstone formations 104 on either side of the shale formation 102.

As shown in the figure, two expandable tubing sections 12 (e.g., expandable sand screens) are separated by an unexpanded tubing section 14. Note that the expandable tubing sections 12 may be referred to as expandable portions of a sand screen completion and the unexpanded tubing sections 14 may be referred to as intermediate unexpanded portions in that the unexpanded portions are intermediate expandable sand screen portions of the sand screen completion.

The unexpanded tubing section 14 has a crossover 106 on each end connecting the unexpanded tubing section 14 to each of the expandable tubing section 12. A gravel packing sub 68 is provided in the unexpanded tubing section 14. Using a procedure similar to that described in connection with FIG. 7, the portion of the well 16 surrounding the unexpanded tubing section 14 and between the expandable tubing section 12 is gravel packed. A service string 72 is run into the well 16 into operative engagement with the gravel packing sub 68 and the gravel pack operation is performed. Accordingly, the present invention comprises the method of expanding a plurality of expandable sand screens in a well 16, the expandable sand screens connected to one another by an unexpanded tubing section 14, and gravel packing the portion of the well 16 around the unexpanded tubing portion and between the expandable sand screen.

Note that the gravel pack may also flow to at least a portion of the area surrounding the expandable tubing section 12 if, for example, the expandable tubing section 12 is not fully expanded, if an annulus is formed around the expandable tubing section 12, or if other flow paths exist through which the gravel pack may flow. Therefore, the present invention provides a method for gravel packing around an expandable tubing section 12 (e.g., an expandable sand screen).

Figure 9:
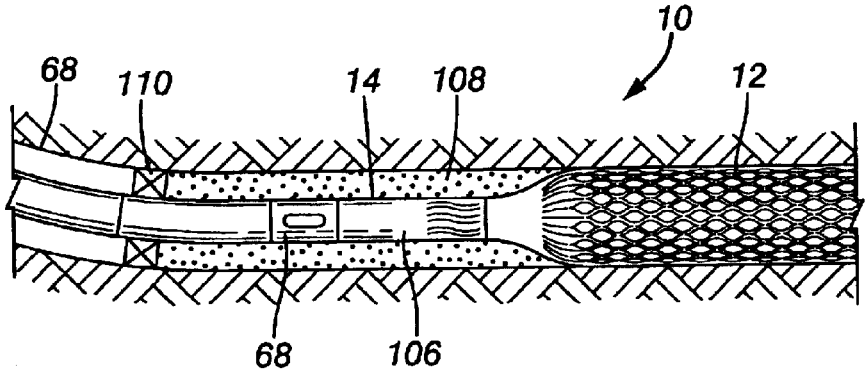
FIG. 9 illustrates an embodiment of the present invention in which a portion of the well is gravel packed.

FIG. 9 illustrates another alternative embodiment in which the gravel packing sub 68 is provided above the expandable tubing section 12 to gravel pack the area 108 above the expandable tubing section 12. The embodiment of FIG. 9, like those of FIGS. 6–8 may be used to provide a gravel pack around an expandable tubing section 12, such as an expandable sand screen. A packer 110 at the upper end of the completion may be used as shown. The gravel packing sub 68 may have a closable sleeve therein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

We claim:

1. A well completion, comprising:

at least two expandable tubing sections expanded in a well;

an unexpanded tubing section connected to and between the at least two expandable tubing sections;

a seal on an exterior of the unexpanded tubing section.

2. The completion of claim 1, wherein the seal is an external casing packer.

3. The completion of claim 1, further comprising:

the at least two expandable tubing sections and the unexpanded tubing section forming an outer conduit;

an inner completion at least a portion of which is positioned in the outer conduit, the inner completion comprising a tubing and a seal.

4. The completion of claim 3, wherein the inner completion further comprises:

the seal providing a seal between the tubing and the unexpanded tubing section;

so that the seal substantially isolates the expandable tubing sections from one another.

5. The completion of claim 4, wherein the seal is a packer.

6. The completion of claim 3, wherein the inner completion further comprises:

a valve adapted to control the flow of fluid into/from the tubing.

7. The completion of claim 1, further comprising:

a tubing positioned within the at least two expandable tubing sections and the unexpanded tubing section; and a seal between the tubing and the unexpanded tubing section.

8. The completion of claim 7, further comprising a valve connected to the tubing, the valve adapted to control the flow of fluid into/from the tubing.

9. The completion of claim 7, wherein the seal is selected from a packer and a seal assembly.

10. The completion of claim 7, further comprising an intelligent completion device.

11. The completion of claim 1, further comprising a gravel pack provided about the unexpanded tubing section.

12. The completion of claim 1, further comprising a gravel packing sub connected to the unexpanded tubing section.

13. The completion of claim 1, wherein the expandable tubing sections comprise expandable sand screens.

14. A completion system for a well having a plurality of production zones, comprising:

a first expandable tubing section positioned and expanded in a first production zone;

a second expandable tubing section positioned and expanded in a second production zone;

an unexpanded tubing section between the first and second expandable tubing sections;

a seal between the unexpanded tubing section and the well.

15. The completion system of claim 14, wherein the seal is an external casing packer.

16. The completion system of claim 14, further comprising:

a seal between at least one of the expandable tubing sections and the well isolating the production zones.

17. The completion system of claim 14, wherein the unexpanded tubing section is connected to one or more of the first and second expandable tubing sections.

18. The completion system of claim 14, further comprising:

the first and second expandable tubing sections and the unexpanded tubing section defining an outer completion;

an inner completion positioned within the outer completion;

the inner completion having a tubing and an inner seal, the inner seal positioned between the tubing and the unexpanded tubing section.

19. The completion system of claim 18, further comprising:

an outer seal between the unexpanded tubing section and the well;

the inner seal dividing the tubing into a first portion and a second portion;

the first expandable tubing section and the first portion defining a first isolated completion;

the second expandable tubing section and the second portion defining a second isolated completion.

20. The completion of claim 19, further comprising a valve adapted to control the flow of fluid into/from the tubing, the valve positioned in the first completion.

21. The completion of claim 19, further comprising an intelligent completion device positioned in the first completion.

22. The completion of claim 18, further comprising a control line extending between the inner completion and the outer completion.

23. The completion system of claim 14, further comprising a gravel packing sub in the unexpanded tubing section.

24. The completion system of claim 14, further comprising a gravel pack around the unexpanded tubing section.

25. The completion system of claim 14, further comprising a gravel pack in a rat hole of the well.

26. A sand screen completion, comprising:

an expandable sand screen portion expanded in a well;

an intermediate unexpanded portion;

an outer seal on the unexpanded portion.

27. The completion system of claim 26, further comprising a gravel pack around the unexpanded portion.

28. A method of completing a well, comprising:

providing an inner completion and an outer completion;

expanding a portion of the outer completion;

isolating portions of the well by sealing between the inner completion and an unexpanded portion of the outer completion.

29. The method of claim 28, further comprising running a control line between the inner completion and the outer completion.

30. The method of claim 28, further comprising controlling the flow of one isolated portion independently from the flow of another isolated portion.

* * * * *